US009155348B2

(12) United States Patent
Cho

(10) Patent No.: US 9,155,348 B2
(45) Date of Patent: Oct. 13, 2015

(54) HAT USING SHAPE-MAINTENANCE ENHANCING MEMBER

(75) Inventor: Byoung-Woo Cho, Seoul (KR)

(73) Assignee: Yupoong, Inc., Seoul (KR)

( * ) Notice: Subject to any disclaimer, the term of this patent is extended or adjusted under 35 U.S.C. 154(b) by 593 days.

(21) Appl. No.: 13/456,852

(22) Filed: Apr. 26, 2012

(65) Prior Publication Data

US 2012/0272432 A1 Nov. 1, 2012

(30) Foreign Application Priority Data

Apr. 28, 2011 (KR) ..... 10-2011-0040364

(51) Int. Cl.
*A42C 1/00* (2006.01)
*A42B 1/00* (2006.01)

(52) U.S. Cl.
CPC .. *A42C 1/00* (2013.01); *A42B 1/002* (2013.01)

(58) Field of Classification Search
CPC ..... A42B 1/002; A42B 1/061
USPC ..... 2/195.5, 209.12, 175.3, 175.4, 195.1, 2/171, 171.1, 264, 200.1, 410
See application file for complete search history.

(56) References Cited

U.S. PATENT DOCUMENTS 1,984,521 A * 12/1934 Deegan ..... 2/195.5
2,681,451 A * 6/1954 Lipschutz ..... 2/175.4
3,133,289 A * 5/1964 Lipschutz ..... 2/195.6
4,691,389 A * 9/1987 Meyer ..... 2/195.5
2004/0231031 A1 11/2004 Cho
2004/0250336 A1* 12/2004 Cho ..... 2/171
2006/0090244 A1 5/2006 Cho
2007/0079424 A1* 4/2007 Cho ..... 2/195.1
2010/0083421 A1* 4/2010 Cho ..... 2/171.2

FOREIGN PATENT DOCUMENTS

JP 11-043815 2/1999
KR 20-0270859 3/2002
KR 1020040099565 12/2004
KR 1020060124234 12/2006

* cited by examiner

*Primary Examiner* — Danny Worrell
*Assistant Examiner* — Khaled Annis
(74) *Attorney, Agent, or Firm* — Fellers, Snider, Blankenship, Bailey & Tippens, P.C.

(57) ABSTRACT

The present invention relates to a hat using a shape-maintenance enhancing member and a method for manufacturing the same. In particular, the present invention relates to a hat using a shape-maintenance enhancing member that can maintain the exterior appearance of the hat by eliminating wrinkles in a sewing portion using a flexible tape and maintain the shape of the hat to be the same as the initial design, and a method for manufacturing the hat. The shape-maintenance enhancing member according to an exemplary embodiment of the present invention includes a main body portion disposed on the sewing portion and a wing portion surrounding the sewing portion, and the main body portion includes a shape-maintenance enhancing layer formed of a material with properties of heat fusion and thermal fixation and a cover portion connected with the wing portion.

8 Claims, 7 Drawing Sheets

HAT USING SHAPE-MAINTENANCE ENHANCING MEMBER

CROSS REFERENCE TO RELATED APPLICATIONS

This application claims priority to and the benefit of Korean Patent Application No. 10-2011-0040364 filed in the Korean Intellectual Property Office on Apr. 28, 2011, the entire contents of which are incorporated herein by reference.

FIELD OF THE INVENTION

The present invention relates to a hat using a shape-maintenance enhancing member and a method for manufacturing the same. In particular, the present invention relates to a hat using a shape-maintenance enhancing member that can secure the exterior appearance of the hat as designed by preventing wrinkles around a sewing portion with a flexible tape and keeping the shape of the hat to stay the same as the initial design, and a method for manufacturing the hat.

BACKGROUND OF THE INVENTION

In general, in manufacturing of a head receiving portion of a hat, a plurality of pieces of fabric are sewed to form the shape of the head receiving portion and the sewed portion is surrounded with a piece of fabric cut in the shape of a tape and then sewing is performed to prevent exposure of the sewed portion.

As for the tape-shaped cloth, a flexible tape, e.g., a woven bias-cutting tape or a tricot tape, is used to be smoothly aligned along the curved portion connected by sewing in the head receiving portion.

However, in the finished head receiving portion, the flexible tape has disadvantage due to its characteristic of tension that causes wrinkles in the portion where the plurality of piece cloths are connected in the head receiving portion. The entire exterior shape of the hat may be loosened or shrunk so that it may be different from the pattern in the initial design.

In order to solve the problem, the possible deformation of the fabric and the tape are considered in the design phase, or the shape of the hat is adjusted with a high-temperature steam mold after sewing is finished.

However, it is difficult to accurately measure the amount of deformation due to properties of the fabric or the flexible tape, and the shape deformed during the sewing is not fully restored to its previous condition. Moreover, the shape adjusted by the steam mold is deformed once again as time passes because the flexible tape and a plurality of panels forming the head receiving portion are gradually contracted.

The contraction of the fabric and the flexible tape of the head receiving portion causes deformation of the external appearance of the hat, and the quality of the hat may be deteriorated.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a hat using a shape-maintenance enhancing member that can stabilize the shape of a head receiving portion of the hat, and a method for manufacturing the same.

In addition, the present invention provides a hat using a shape-maintenance enhancing member that can maintain the initial shape of the head receiving portion without causing deformation of interior and exterior appearances, such as unevenness of the sewing portion or twist of the flexible tape not only at initial design but also after a long period of time, and a method for manufacturing the same.

A method for manufacturing a hat including a head receiving portion formed of a plurality of panels and a shape-maintenance enhancing member surrounding sewing portions of the plurality of panels forming the head receiving portion, includes: cutting fabric into panels for forming the head receiving portion; primarily sewing the cut-out panels; preparing the shape-maintenance enhancing member with properties of a heat fusion and thermal fixation, to be coupled with the sewing portion of the primarily sewn panels; secondarily sewing the shape-maintenance enhancing member with the plurality of panels forming the head receiving portion; and forming the secondarily sewn head receiving portion to the shape of a hat through a molding process using a steam mold.

A hat according to an exemplary embodiment of the present invention includes a head receiving portion formed of a plurality of panels and a shape-maintenance enhancing member provided in sewing portions of the plurality of panels forming the head receiving portion. The shape-maintenance enhancing member includes a main body portion disposed on the sewing portion and a wing portion surrounding the sewing portion, and the main body portion includes a shape-maintenance enhancing layer formed of a material having a heat fusion and thermal fixation property and a cover portion connected with the wing portion.

According to an exemplary embodiment of the present invention, contraction of a flexible tape used to surround a sewing portion between pluralities of panels forming a conventional hat can be avoided from a sewing process.

In addition, according to the exemplary embodiment of the present invention, when the high-temperature steam mold applies heat and pressure to the shape-maintenance enhancing member to form the shape of the hat after the hat is sewn, the shape-maintenance enhancing layer in the main body portion of the shape-maintenance enhancing member is heat-melted between the sewing portion of the head receiving portion and the cover layer of the main body portion and then thermally fixed from cooling so that contraction of the head receiving portion can be prevented.

Further, according to the exemplary embodiment of the present invention, the desired shape of the head receiving portion can be produced as originally designed without regarding contraction of panels forming the head receiving portion and the flexible tape that may possibly occur during the cutting-out process of the panels.

In addition, according to the exemplary embodiment of the present invention, the shape-maintenance enhancing member is fixed to the head receiving portion so that the entire shape of the hat can be stabilized and the head receiving portion of the hat can maintain smooth interior and exterior appearances without any unevenness or twist after a long period of time.

Further, according to the exemplary embodiment of the present invention, the shape-maintenance enhancing layer is integrated with the sewing portion of the head receiving portion so that the shape of the hat can be maintained uniformly and smoothly for a long period of time without insertion of a support band or an assistance band.

DETAILED DESCRIPTION OF THE PREFERRED EMBODIMENTS

Figure 1A:
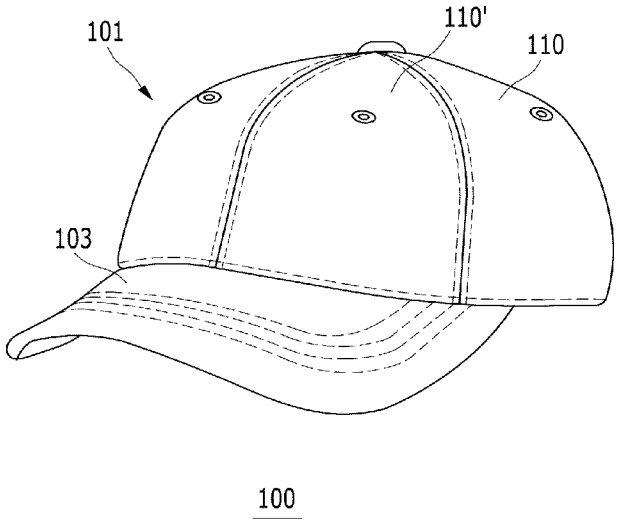
FIG. 1A is a top perspective view of a hat according to an exemplary embodiment of the present invention.

Hereinafter, an exemplary embodiment of the present invention will be described in further detail with the accompanying drawings.

In the drawings, explanatorily irrelevant portions are omitted to clearly describe the present invention, and like reference numerals designate like elements throughout the specification.

Furthermore, in case it is judged that the detailed description of the well-known function or structures relevant to the embodiments may needlessly obscure the gist of the present invention, such a description will be omitted.

Figure 1B:
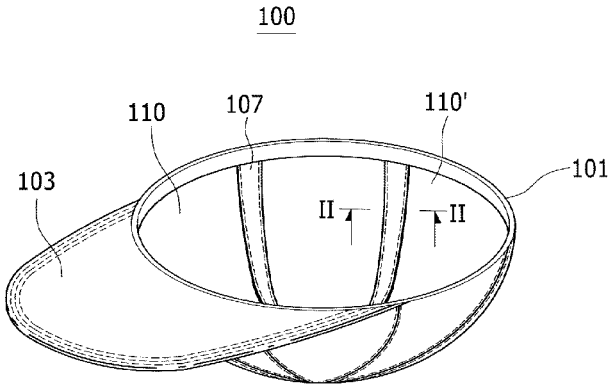
FIG. 1B is a bottom perspective view of the hat according to the exemplary embodiment of the present invention.
Figure 2:
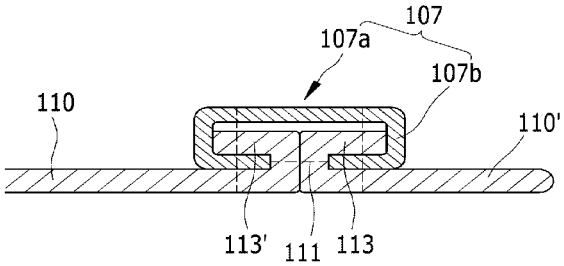
FIG. 2 is a cross-sectional view of FIG. 1B, taken along the line II-II.
Figure 3:
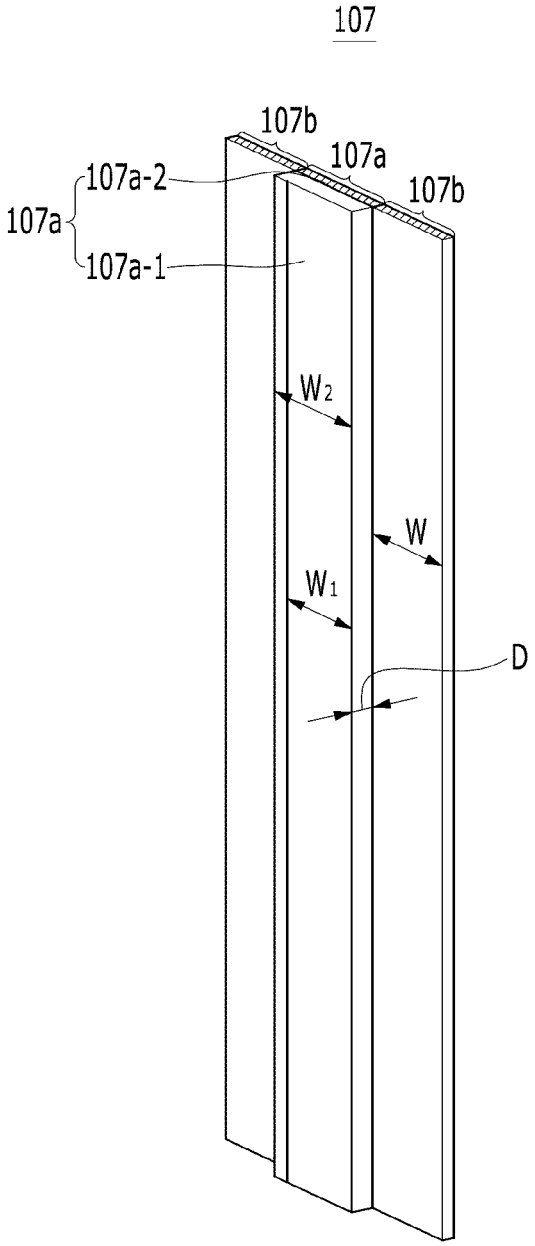
FIG. 3 is a perspective view of a shape-maintenance enhancing member for enhancing the shape-maintenance of the head receiving portion of the hat according to the exemplary embodiment of the present invention.

FIG. 1A is a top perspective view of a hat according to an exemplary embodiment of the present invention, FIG. 1B is a bottom perspective view of the hat according to the exemplary embodiment of the present invention, FIG. 2 is a cross-sectional view of FIG. 1B, taken along the line II-II, and FIG. 3 is a perspective view of a shape-maintenance enhancing member for enhancing the shape-maintenance of the head receiving portion of the hat according to the exemplary embodiment of the present invention.

As shown in FIG. 1A and FIG. 1B, a hat 100 according to an exemplary embodiment of the present invention includes a head receiving portion 101 disposed on the head to surround the head of a wearer and a visor portion 103 coupled to one side of the head receiving portion 101 to block direct sunlight. The head receiving portion 101 is formed of a plurality of panels 110 and includes a shape-maintenance enhancing member 107 surrounding a sewing line between the plurality of panels 110 and neighboring panels 110' along a direction of the height of the head in the head receiving portion 101.

In further detail, as shown in FIG. 2, the head receiving portion 101 includes sewing portions 113 and 113' provided as margins at cutting out of initial panels 110 and 110' so as to connect neighboring panels 110 and 110' among the plurality of panels 110 and 110' forming the head receiving portion 101 by primary sewing along a sewing line 111 and the shape-maintenance enhancing member 107 preventing strands from being run or the primary sewing line 111 from being torn by surrounding the sewing portions 113 and 113'.

In particular, as shown in FIG. 3, the shape-maintenance enhancing member 107 includes a main body portion 107*a* to be disposed on the sewing portions 113 and 113' formed along the head height direction of the head receiving portion 101 and a wing portion 107*b* formed of a flexible material to cover the sewing portions 113 and 113' spread toward the neighboring panels 110 and 110' that form the head receiving portion 110 by surrounding the same so as to prevent feeling of hardness or protrusion from being imparted when the hat is worn on the head.

The main body portion 107*a* may include a shape-maintenance enhancing layer 107*a*-1 formed of a material having thermal fusion/thermal fixation properties so as to be melt at a temperature of approximately 100° C., preferably at 95° C., and cooled and thermally fixed at the same time, preferably having self adhesiveness, and may further include a cover layer 107*a*-2 for preventing exposure of the shape-maintenance enhancing layer 107*a*-1 to the outside by covering the same.

The shape-maintenance enhancing layer 107*a*-1 may be a polymer synthetic resin having flexibility and elasticity for convenience of sewing, or preferably has self adhesiveness.

The shape-maintenance enhancing layer 107*a*-1 may be formed in the shape of a flexible and elastic film to provide smoothness and maintain a smooth shape, and preferably may be a polyolefine-based, polyurethane-based, or polyamides-based polymer synthetic resin.

The polymer synthetic resin may be directly coated or impregnated to the cover layer 107*a*-2.

As shown in Table 1, by virtue of the film formed of the polymer synthetic resin, a needle can easily penetrate the shape-maintenance enhancing layer 107*a*-1 in sewing thereof, and the shape-maintenance enhancing layer 107*a*-1 is adapted to be melted by a temperature of about approximately 100° C., that is, heat and pressure from a steam mold, cooled, and at the same time, thermally fixed. In addition, the shape-maintenance enhancing layer 107*a*-1 has a thickness of 10-100 μm, preferably, 20-60 μm (1 micron=1/1000 mm) to prevent contraction and loose of the panel 110 or 110' or the cover layer 107*a*-2 by being not exposed through but coupled to the panel 110 or 110' or the cover layer 107*a*-2 in a fixed manner. The sewing portion is basically stiff and uneven because a fabric panel is multiple layered in sewing, but in the present exemplary embodiment, the shape-maintenance enhancing layer 107*a*-1 is made thin so that there is hardly no thickness difference before and after completion, the unevenness can be solved, and the sewing portion can be flat.

TABLE 1

| | 10-100 μm | 110-200 μm | 210 to 300 μm | 310 to 400 μm |
|---|---|---|---|---|
| Sewing convenience | 0 | x | x | X |
| Shape-maintenance | 0 | 0 | 0 | 0 |
| Leakage from thermal melting | x | 0 | 0 | 0 |

The cover layer 107*a*-2 may be integrally formed to the wing portion 107*b*, and preferably, like the wing portion 107*b*, the cover layer 107*a*-2 may be formed of a flexible tape, e.g., a woven bias cutting tape or a tricot tape, and in this case, the cover layer 107*a*-2 can be smoothly arranged without being bent along the portion connected by sewing in the curvaceous head receiving portion 101.

Unlike the conventional example, in the hat 100 using the above-described shape-maintenance enhancing member 107 can be realized with the initial design shape without regarding contraction and loose of the panels forming the head receiving portion 101 and the flexible tape in cutting of the panels. For example, the length of the head height direction of the hat is the same as that in the initial design after the hat is completed.

In addition, according to the exemplary embodiment of the present invention, the shape-maintenance enhancing layer 107*a*-1 has a thickness of 10-100 μm, preferably, 20-60 μm (1 micron=1/1000 mm), and therefore the needle can be easily penetrated and the sewing can be easily performed without twist of the flexible tape because the shape-maintenance enhancing layer 107*a*-1 has predetermined elasticity.

In addition, when heat and pressure are applied to the hat using a high-temperature steam mold for molding of the shape of the hat after the hat is sewn, the shape-maintenance enhancing layer 107*a*-1 in the main body portion 101 of the shape-maintenance enhancing member 107 is melted but cooled quickly at room temperature so that shape-maintenance enhancing layer 107*a*-1 is thermally fixed between the sewing portion 113 and the cover layer 107*a*-2 of in main body portion 107*a* of the head receiving portion, thereby preventing contamination of the cover layer 107*a*-2 or the sewing portions 113 and 113' and preventing contraction and loose of the head receiving portion 101.

That is, the whole shape of the hat can be stabled, the wrinkle in the exterior appearance of the head receiving portion 101 can be improved, and the inner surface of the head receiving portion 101 can be flat without having torsion or twist, thereby increasing commercial value of the hat.

Hereinafter, referring to FIG. 4A to FIG. 5, a method for manufacturing a hat having a head receiving portion formed of a plurality of panels according to an exemplary embodiment of the present invention will be described.

Figure 4A:
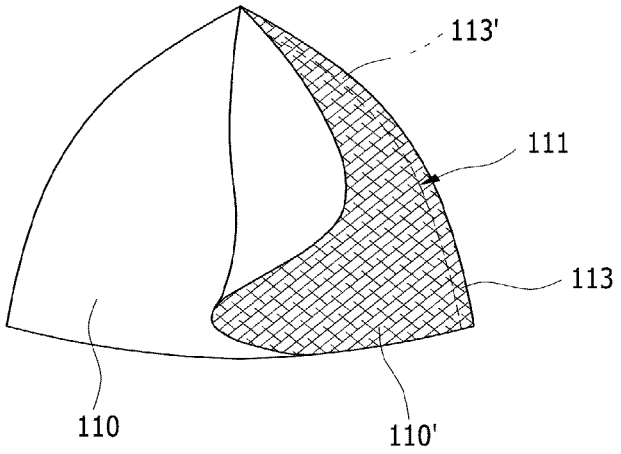
FIG. 4A and FIG. 4B are schematic diagrams for description of the hat according to the exemplary embodiment of the present invention.
Figure 4B:
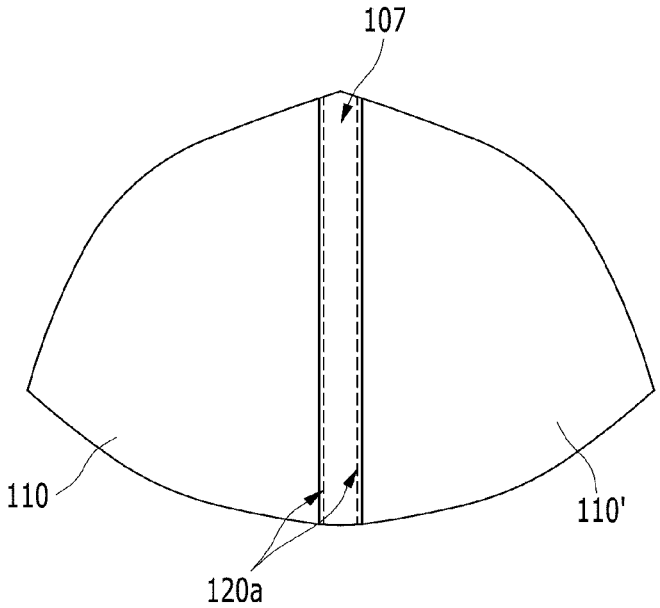
Figure 5:
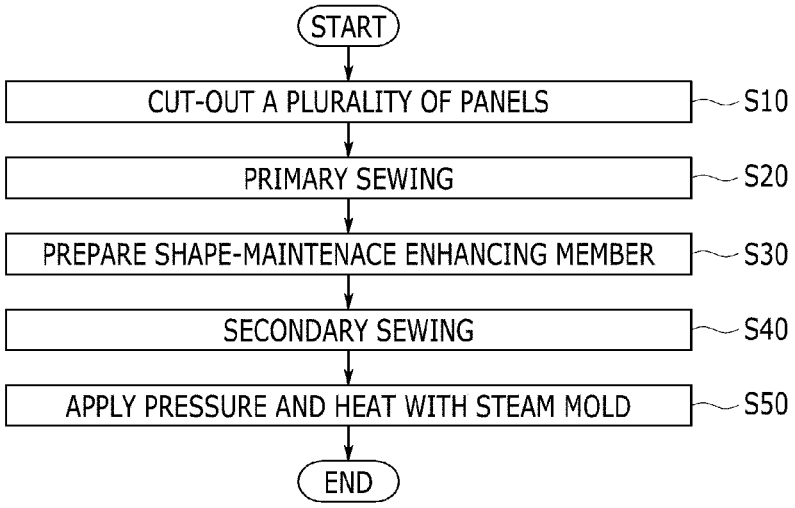
FIG. 5 is a flowchart for description of a method for manufacturing a hat according to an exemplary embodiment of the present invention.

FIG. 4A and FIG. 4B are schematic diagrams for description of the manufacturing method of the hat according to the exemplary embodiment of the present invention, and FIG. 5 is a flowchart of the manufacturing method of the hat according to the exemplary embodiment of the present invention.

As shown in FIG. 4A, panels 110 and 110' are cut to form a head receiving portion 101 (S10), outer surfaces of neighboring panels 110 and 110' among the cut panels 110 and 110' are overlapped, and then, primary sewing is performed along a sewing line 111 (S20).

In this case, sewing portions 113 and 113' are provided as margins in the cutting for connection by sewing between the neighboring panels 110 and 110' among the cut panels 110 and 110' along the sewing line 111.

Sequentially, the sewing portions 113 and 113' of the primarily sewn panels are bent back toward the panels 110 and 110' thereof to arrange the sewing portions 113 and 113' in both directions and the shape-maintenance enhancing member 107 is prepared (S30).

In order to prepare the shape-maintenance enhancing member 107, a shape-maintenance enhancing layer 107*a*-1 may be formed as a tape, the cover layer 107*a*-2 and the wing portion 107*b*-1 are formed as a single flexible tape, and the cover layer 107*a*-2 and the wing portion 107*b*-1 may be prepared by coating or impregnating a material having heat fusion/thermal fixation property to the flexible tape.

The shape-maintenance enhancing member 107 is coupled with the sewing portions 113 and 113 by secondary sewing (S40).

An external guide means may be used for constant alignment of the shape-maintenance enhancing member 107 on the sewing portions 113 and 113'.

Simultaneously or sequentially with the arrangement of the shape-maintenance enhancing layer 107*a*-1, the cover layer 107*a*-2 of the shape-maintenance enhancing member 107 may be aligned.

In the case that the wing portion 107*b* uses an integrally formed flexible tape, a flexible tape formed by integrally forming the cover layer 107*a*-2 and the wing portion 107*b* may be disposed on the sewing portions 113 and 113' independently with the shape-maintenance enhancing layer 107*a*-1.

When the shape-maintenance enhancing member 107 is coupled by sewing on the sewing portions 113 and 113', the wing portion 107*b* surrounds the sewing portions 113 and 113'.

As shown in FIG. 4B, a needle is penetrated to the plurality of panels 110 and 110' forming the head receiving portion 101 on the main body portion 107*a* of the shape-maintenance enhancing member 107 to perform secondary sewing along a secondary sewing line 120*a* such that running of strands from the primary sewing line 111 can be prevented and the sewing line 111 can be prevented from being torn.

When the hat is completed through the above-process, heat and pressure are applied to the hat using a steam mold to shape the hat through a molding process (S50).

In this case, the shape-maintenance enhancing layer 107*a*-1 formed of a polymer synthetic resin having a thickness of 10-100 μm, preferably 20-60 μm (1 micron=1/1000 mm) is melted between the sewing portion 113 of the head receiving portion 101 and the cover layer 107*a*-2 of the main body portion 107*a* and then thermally fixed when being cooled such that constant fixation can be provided for a long period of time with respect to the head receiving portion 101, thereby preventing contraction and loose of the head receiving portion 101.

Meanwhile, the shape-maintenance enhancing layer 107*a*-1 also provides a predetermined level of elasticity together with the fixation when being thermally fixed by cooling after melting so that the shape can be stably maintained.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

DESCRIPTION OF SYMBOLS

101: head receiving portion
110, 110': cut panel
111: sewing line
120*a*: secondary sewing line
113, 113': sewing margin portion
107: shape memory enhancing member
107*a*: main body portion
107*b*: wind portion
107*a*-1: shape memory enhancing layer
107*a*-2: cover layer

What is claimed is:

1. A hat comprising a head receiving portion formed of a plurality of panels, each of the panels defining a sewing portion at an edge of the panels such that the sewing portions of adjacent panels are adjacent one another, and a shape-maintenance enhancing member coupled to the sewing portions of the plurality of panels forming the head receiving portion, wherein the shape-maintenance enhancing member comprises a main body portion and a wing portion, said main body portion disposed on the sewing portion, said wing portion having flexibility to surround the sewing portion, and the main body portion comprises a cover layer and a shape-maintenance enhancing layer, said shape-maintenance enhancing layer thermally fixed between said sewing portion and said cover layer for preventing contamination of said cover layer and said sewing portion and for preventing contraction and loosening of the head receiving portion.

2. The hat of claim 1, wherein the wing portion and the cover layer are integrally formed.

3. The hat of claim 1, wherein the shape-maintenance enhancing layer is formed of a polymer synthetic resin film.

4. The hat of claim 1, wherein the wing portion and the cover layer are formed of a fabric or a knit.

5. A hat comprising:

a head receiving portion comprised of a first panel and a second panel, said first panel and said second panel adjacent to one another, said first panel and said second panel defining a seam therebetween;

a sewing line joining said first panel and said second panel at said seam;

wherein said first panel defines a first sewing portion at an edge of said first panel, said first sewing portion extending interiorly to said head receiving portion inside of said sewing line;

wherein said second panel defines a second sewing portion at an edge of said second panel, said second sewing portion extending interiorly to said head receiving portion inside of said sewing line;

a shape-maintenance enhancing member having a main body portion, a first wing portion and a second wing portion, wherein said main body portion, said first wing portion, and said second wing portion define a partial enclosure;

wherein said first sewing portion and said second sewing portion are received within said partial enclosure of said shape-maintenance enhancing member;

a shape-maintenance enhancing layer of said main body portion of said shape-maintenance enhancing member adjacent to said first sewing portion and said second sewing portion; wherein said main body portion comprises a cover layer and said shape-maintenance enhancing layer, said shape-maintenance enhancing layer thermally fixed between said sewing portion and said cover layer for preventing contamination of said cover layer and said sewing portion and for preventing contraction and loosening of the head receiving portion.

6. The hat of claim 5, wherein the shape-maintenance enhancing layer is formed of a polymer synthetic resin film.

7. The hat of claim 5, wherein said main body portion, said first wing portion and said second wing portion are integrally formed.

8. The hat of claim 5, wherein said first wing portion, said second wing portion and said main body portion are formed of a fabric or a knit.

* * * * *